US011009040B2

(12) United States Patent
Nonaka et al.

(10) Patent No.: US 11,009,040 B2
(45) Date of Patent: May 18, 2021

(54) VACUUM PUMP

(71) Applicant: Edwards Japan Limited, Yachiyo (JP)

(72) Inventors: Manabu Nonaka, Yachiyo (JP); Takashi Kabasawa, Yachiyo (JP)

(73) Assignee: Edwards Japan Limited, Chiba (JP)

( * ) Notice: Subject to any disclaimer, the term of this patent is extended or adjusted under 35 U.S.C. 154(b) by 709 days.

(21) Appl. No.: 15/115,094

(22) PCT Filed: Jan. 8, 2015

(86) PCT No.: PCT/JP2015/050316
§ 371 (c)(1),
(2) Date: Jul. 28, 2016

(87) PCT Pub. No.: WO2015/118897
PCT Pub. Date: Aug. 13, 2015

(65) Prior Publication Data

US 2017/0002832 A1 Jan. 5, 2017

(30) Foreign Application Priority Data

Feb. 4, 2014 (JP) ..... JP2014-019654

(51) Int. Cl.
*F04D 29/54* (2006.01)
*F04D 19/04* (2006.01)
(Continued)

(52) U.S. Cl.
CPC ..... *F04D 29/545* (2013.01); *F04D 19/044* (2013.01); *F04D 19/046* (2013.01);
(Continued)

(58) Field of Classification Search
CPC .. F04D 29/584; F04D 29/5853; F04D 29/545; F04D 19/044; F04D 19/046;
(Continued)

(56) References Cited

U.S. PATENT DOCUMENTS 5,924,841 A * 7/1999 Okamura ..... F04D 29/5853 415/90
2002/0114695 A1* 8/2002 Fahrenbach ..... F04D 29/5853 415/90

(Continued)

FOREIGN PATENT DOCUMENTS

JP H04116693 * 10/1992 ..... F04D 19/04
JP H0538389 5/1993

(Continued)

OTHER PUBLICATIONS

EPO, Translation of JPH04116693, retrieved Mar. 11, 2019. (Year: 2019).*

(Continued)

*Primary Examiner* — Michael Lebentritt
*Assistant Examiner* — Jesse M Prager
(74) *Attorney, Agent, or Firm* — Theodore M. Magee; Westman, Champlin & Koehler, P.A.

(57) ABSTRACT

To provide a vacuum pump capable of heating only a flow channel extending from the vicinity of an exit of a thread groove exhaust flow channel toward an outlet port and prevents the accumulation of a product that is caused by a decrease in the temperature of process gas near the exit of the thread groove exhaust flow channel and the flow channel. A vacuum pump has a thread groove exhaust portion that has thread groove exhaust flow channels at least in respective parts of portions on inner and outer circumferential sides of a rotor (rotating body), a casing enclosing the thread groove exhaust portion, an outlet port for exhausting gas compressed by the thread groove exhaust portion to the outside of the casing, and a partition wall that covers a flow channel extending from the exits of the thread groove exhaust flow channels toward the outlet port.

16 Claims, 10 Drawing Sheets

(51) Int. Cl.
*F04D 29/52* (2006.01)
*F04D 29/58* (2006.01)

(52) U.S. Cl.
CPC ..... *F04D 29/522* (2013.01); *F04D 29/584* (2013.01); *F04D 29/5853* (2013.01); *F05B 2240/12* (2013.01); *F05B 2240/14* (2013.01); *F05B 2240/51* (2013.01); *F05B 2260/231* (2013.01); *F05B 2280/1021* (2013.01); *F05B 2280/6015* (2013.01); *F05D 2260/607* (2013.01)

(58) Field of Classification Search
CPC ..... F04D 29/522; F05D 2260/231; F05D 2260/607; F05B 2240/12; F05B 2240/14; F05B 2240/51; F05B 2280/1021; F05B 2280/6015
See application file for complete search history.

(56) References Cited

U.S. PATENT DOCUMENTS

2003/0102748 A1 6/2003 Yashiro et al.
2003/0175131 A1* 9/2003 Ishikawa ..... F04D 19/04 417/353
2008/0260518 A1* 10/2008 Blumenthal ..... F04D 19/044 415/90
2015/0226229 A1* 8/2015 Tsutsui ..... F04D 19/042 415/47

FOREIGN PATENT DOCUMENTS

JP H06159287 A 6/1994
JP H0972293 A 3/1997
JP H09310696 A 12/1997
JP H09324789 A 12/1997
JP 2002276586 A 9/2002
JP 2010025122 A 2/2010
JP 2011007049 A 1/2011
JP 2011052628 A 3/2011

OTHER PUBLICATIONS

Communication dated Jul. 28, 2017 and Supplemental Search Report dated Jul. 21, 2017 for corresponding European Application No. EP15745756.
PCT International Search Report dated Apr. 14, 2015 for corresponding PCT Application No. PCT/JP2015/050316.
PCT International Written Opinion dated Apr. 2, 2015 for corresponding PCT Application No. PCT/JP2015/050316.

* cited by examiner

VACUUM PUMP

CROSS-REFERENCE TO RELATED APPLICATION

This Application is a Section 371 National Stage Application of International Application No. PCT/JP2015/050316, filed Jan. 8, 2015, which is incorporated by reference in its entirety and published as WO 2015/118897 A1 on Aug. 13, 2015 and which claims priority of Japanese Application No. 2014-019654, filed Feb. 4, 2014.

BACKGROUND OF THE INVENTION

1. Field of the Invention

The present invention relates to a vacuum pump that is used as a gas exhaust means and the like of a process chamber or other chambers of a semiconductor manufacturing apparatus, a flat panel display manufacturing apparatus, and a solar panel manufacturing apparatus.

2. Description of the Related Art

A vacuum pump P10 shown in FIG. 10, for example, has conventionally been known as this type of vacuum pump. The vacuum pump P10 (referred to as "conventional pump P10" hereinafter) has a blade exhaust portion Pt and a thread groove exhaust portion Ps as a mechanism for compressing/exhausting gas by means of the rotation of a rotor 6.

In particular, a specific configuration of the thread groove exhaust portion Ps of this conventional pump P10 employs a system for compressing/exhausting the gas in a direction shared by a thread groove exhaust flow channel R1 on the inner circumferential side of the rotor 6 and a thread groove exhaust flow channel R2 on the outer circumferential side of the rotor 6 (parallel flow type), and this system provides an advantage in having a high exhaust speed. Such parallel flow type vacuum pump is disclosed in, for example, Japanese Utility Model Application Publication No. H5-38389.

Incidentally, the conventional pump P10 has a flow channel S extending from the vicinity of the exits of the thread groove exhaust flow channels R1, R2 toward an outlet port 3, the flow channel S being a section that comes into contact with process gas, the pressure of which is increased as a result of being compressed by the pump. The sublimation gas contained in the process gas becomes gas or a solid body due to the temperature and partial pressure thereof, and easily solidifies in a low-temperature or high-partial pressure environment. Therefore, unless the wall temperatures in the vicinity of the exits of the thread groove exhaust flow channels R1, R2 and of the flow channel S are kept high, the process gas solidifies and accumulates in the form of a product in the vicinity of the exits of the thread groove exhaust flow channels R1, R2 or the flow channel S.

However, the conventional pump P10 is provided with a casing 1 (a pump base 1B to be more precise) where the vicinity of the exits of the thread groove exhaust flow channels R1, R2 or the flow channel S comes into contact with the outside air. For this reason, problems arise in that, for example, the wall temperatures in the vicinity of the exits of the thread groove exhaust flow channels R1, R2 and of the flow channel S are low, whereby the compression heat of the process gas is easily dissipated in the vicinity of the exits of the thread groove exhaust flow channels R1, R2 and at the flow channel S, and in that the accumulation of a product occurs in an early stage due to the decrease in the temperature of the process gas, clogging the vicinity of the exits of the thread groove exhaust flow channels R1, R2 and the flow channel S due to the accumulation of the product.

As a way to solve these problems, there is a method for keeping the temperatures in the vicinity of the exits of the thread groove exhaust flow channels R1, R2 and the flow channel S high by providing a heating means such as a band heater on the outside of the casing 1. Unfortunately, this method faces such problems as frequent dissipation of the heat from the casing 1 to the outside due to the casing 1 being exposed to the outside air, poor heating efficiency, the rise in the temperatures of electrical components housed in a stator column 4 coupled to the casing 1 (such as radial magnetic bearings 10, a drive motor 12, etc.), and hence problems in these overheated electrical components.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

The present invention was contrived in order to solve these problems, and an object thereof is to provide a vacuum pump that is not only capable of efficiently heating only a flow channel extending from the vicinity of an exit of a thread groove exhaust flow channel toward an outlet port, but also suitable for preventing the accumulation of a product that is caused as a result of a decrease in the temperature of process gas in the vicinity of the exit of the thread groove exhaust flow channel and the flow channel.

In order to achieve this object, the present invention is characterized in having: a thread groove exhaust portion that has thread groove exhaust flow channels at least in respective parts of portions on inner and outer circumferential sides of a rotating body; a casing enclosing the thread groove exhaust portion; an outlet port for exhausting gas compressed by the thread groove exhaust portion to the outside of the casing; and a partition wall that covers a flow channel extending from exits of the thread groove exhaust flow channels toward the outlet port.

The present invention may be characterized in that the partition wall is joined to a pump component other than the partition wall through a heat insulating material.

The present invention may be characterized in that the outlet port has a multi-cylindrical structure configured with inner and outer cylinders, and that one of the cylinders is attached to the casing and the other cylinder is attached to the partition wall.

The present invention may be characterized in that a port member is attached to the partition wall as a structure of the outlet port.

The present invention may be characterized in that the partition wall or a thread groove pump stator configuring each of the thread groove exhaust flow channels is provided with a heating means and a temperature measuring means.

The present invention may be characterized in having a control means for controlling the heating means.

The present invention may be characterized in that the outlet port is installed so as not to be in contact with a pump component other than the partition wall.

According to the present invention, the specific configuration of the vacuum pump employs the configuration in which the partition wall is provided to cover the flow channel that extends from the exits of the thread groove exhaust flow channels to the outlet port, wherein the partition wall covers the inside of the flow channel from the casing and the outer wall of a stator column coupled thereto. Thus, owing to the facts that the temperature of the process gas passing through the flow channel and the vicinity of the exits of the thread groove exhaust flow channels does not drop easily and that the wall temperatures of the flow channel and the vicinity of the exits of the thread groove exhaust flow channels can be kept high, the present invention can provide a vacuum pump that is suitable for preventing the accumulation of a product that is caused by a decrease in the temperature of the process gas in the vicinity of the exits of the thread groove exhaust flow channels and in the flow channel.

According to the present invention, because the entry and exit of the heat between the flow channel, the casing and stator column coupled thereto is inhibited by the partition wall, not only is it possible to efficiently heat only the flow channel and the vicinity of the exits of the thread groove exhaust flow channels, but also the temperature of the casing can be prevented from being increased by this heating, thereby preventing the rise of the temperatures of the stator column coupled to the casing, and the electrical components housed in the stator column, and consequently avoiding the problems associated with overheating of these electrical components and achieving the lengthening of the lives of the electrical components. In addition, the temperature of the flow channel does not drop even if the casing is provided with a cooling means for protecting the stator column and the electrical components housed in the stator column to cool the casing.

The vacuum pump according to the present invention is suitable for preventing the accumulation of a product as described above and can avoid the problems associated with overheating of the electrical components and lengthening the lives of the electrical components. Therefore, pump maintenance for removing the accumulated product or the like does not need to be executed frequently, and the pump performance is stable, resulting in the improvement of the productivity of the vacuum process.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENTS

The best mode for carrying out the present invention is described hereinafter in detail with reference to the accompanying drawings.

Figure 1:
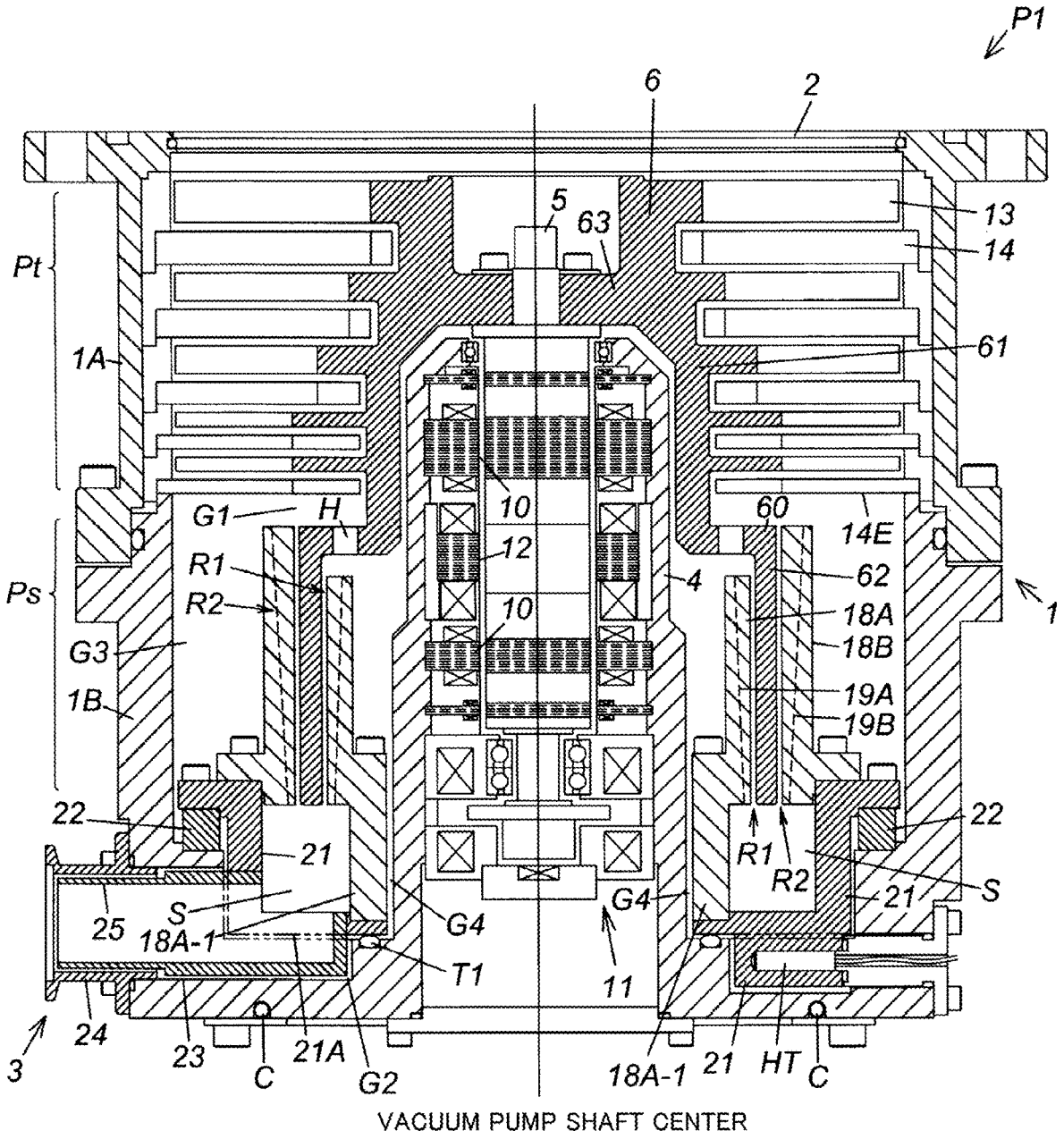
FIG. 1 is a cross-sectional view of a vacuum pump according to an embodiment of the present invention.

FIG. 1 is a cross-sectional view of a vacuum pump (thread groove pump parallel flow type) according to a first embodiment of the present invention.

A vacuum pump P1 shown in FIG. 1 is used as, for example, a gas exhaust means and the like of a process chamber and other sealed chambers of a semiconductor manufacturing apparatus, a flat panel display manufacturing apparatus, and a solar panel manufacturing apparatus.

In the illustrated vacuum pump P1, a casing 1 thereof includes a plurality of pump components such as a blade exhaust portion Pt that exhausts gas by means of rotary blades 13 and stator blades 14, a thread groove exhaust portion Ps that exhausts gas using thread grooves 19A, 19B, and a drive system for driving these components.

The casing 1 is shaped into a bottomed cylinder by integrally coupling a cylindrical pump case 1A and a pump base 1B in the shape of a bottomed cylinder in a cylinder axial direction of the pump base 1B. The upper end side of the pump case 1A is opened as an inlet port 2 for suctioning the gas. A lower end side surface of the pump base 1B is provided with an outlet port 3 as a means for exhausting the gas compressed by the thread groove exhaust portion Ps to the outside of the casing 1.

The inlet port 2 is connected to a sealed chamber in a high vacuum, not shown, such as a process chamber of a semiconductor manufacturing apparatus, by a tightening bolt, not shown, which is provided in a flange 1C at the upper edge of the pump case 1A. The outlet port 3 is connected to an auxiliary pump, not shown.

A cylindrical stator column 4 for housing various electrical components is provided in the center in the pump case 1A. The stator column 4 is integrally provided upright on the inner bottom of the pump base 1B in the vacuum pump P1 shown in FIG. 1. However, in another embodiment, for example, the stator column 4 may be formed as a component separate from the pump base 1B and threadably fixed to the inner bottom of the pump base 1B.

A rotating shaft 5 is provided on the inside of the stator column 4. The rotating shaft 5 is disposed in such a manner that an upper end thereof faces the inlet port 2 and a lower end of the same faces the pump base 1B. The upper end of the rotating shaft 5 is provided to project upward from a cylindrical upper end surface of the stator column 4.

The rotating shaft 5 is supported in a rotatable manner in a radial direction and an axial direction by a pair of radial magnetic bearings 10 and one axial magnetic bearing 11 as a supporting means. In this state, the rotating shaft is driven to rotate by a drive motor 12 functioning as a driving means. Because the radial magnetic bearings 10, the axial magnetic bearing 11 and the drive motor 12 are well known, detailed explanations thereof are omitted.

A rotor 6 functioning as a rotating body is provided on the outside of the stator column 4. The rotor 6 is enclosed by the pump case 1A and the pump base 1B. The rotor 6 is in the shape of a cylinder surrounding the outer circumference of the stator column 4 wherein two cylinders with different diameters (a first cylinder 61 and a second cylinder 62) are coupled together in a cylinder axis direction by a coupling portion 60 that is an annular plate body located substantially in the middle of the rotor 6.

An end member 63 configuring an upper end surface of the first cylinder 61 is provided integrally at an upper end of the first cylinder 61. The rotor 6 is fixed to the rotating shaft 5 with this end member 63 therebetween. At the radial magnetic bearings 10 and the axial magnetic bearing 11, the rotor 6 is also supported through the rotating shaft 5 in a rotatable manner around the shaft center (the rotating shaft 5) thereof.

The rotor 6 of the vacuum pump P1 shown in FIG. 1 is cut out from one aluminum alloy ingot, thereby obtaining the first cylinder 61, the second cylinder 62, the coupling portion 60, and the end member 63 as one component. However, in another embodiment, for example, a configuration may be employed in which the first cylinder 61 and the second cylinder 62 are configured as separate components having the coupling portion 60 therebetween. In this case, the first cylinder 61 and the second cylinder 62 may be formed of different materials. In other words, the first cylinder 61 may be formed of a metallic material such as an aluminum alloy and the second cylinder 62 may be formed of resin.

<<Details of Blade Exhaust Portion Pt>>

In the vacuum pump P1 shown in FIG. 1, the upstream of substantially the middle of the rotor 6 (specifically, the range between the coupling portion 60 and the end of the rotor 6 at the inlet port 2 side) functions as the blade exhaust portion Pt. The blade exhaust portion Pt is now described hereinafter in detail.

A plurality of rotary blades 13 are integrally provided on the outer circumferential surface of the rotor 6 farther on the upstream side from substantially the middle of the rotor 6, i.e., the outer circumferential surface of the first cylinder 61. The plurality of rotary blades 13 are disposed radially side by side, centering on the rotation center axis (the rotating shaft 5) of the rotor 6 or the shaft center of the casing 1 (referred to as "vacuum pump shaft center" hereinafter).

On the other hand, the inner circumferential side of the pump case 1A is provided with a plurality of stator blades 14. The plurality of stator blades 14, too, are disposed radially side by side, centering on the vacuum pump shaft center.

In the vacuum pump P1 shown in FIG. 1, the blade exhaust portion Pt of the vacuum pump P1 is configured by alternately arranging the radially disposed rotary blades 13 and stator blades 14 in multiple stages along the vacuum pump shaft center.

All the rotary blades 13 are blade-like cut products that are cut integrally with an outer diameter machined portion of the rotor 6 and are inclined at an angle optimum for exhausting gas molecules. All the stator blades 14, too, are inclined at an angle optimum for exhausting gas molecules.

<<Explanation of Exhaust Operation by Blade Exhaust Portion Pt>>

In the blade exhaust portion Pt configured as described above, the rotating shaft 5, the rotor 6, and the plurality of rotary blades 13 integrally rotate at high speed upon the start of the drive motor 12, wherein the rotary blade 13 at the top stage provides a downward momentum (the direction from the inlet port 2 toward the outlet port 3) to gas molecules injected from the inlet port 2. The gas molecules with this downward momentum are sent toward the rotary blade 13 of the next stage by the stator blades 14. The process of applying the momentum to the gas molecules and the process of sending the gas molecules described above are repeated in multiple stages, whereby the gas molecules on the inlet port 2 side are exhausted in such a manner as to sequentially shift toward the downstream side of the rotor 6.

<<Details of Thread Groove Exhaust Portion Ps>>

In the vacuum pump P1 shown in FIG. 1, the downstream of substantially the middle of the rotor 6 (specifically, the range between the coupling portion 60 and the end of the rotor 6 at the outlet port 3 side) functions as the thread groove exhaust portion Ps. The thread groove exhaust portion Ps is now described hereinafter in detail.

A part of the rotor 6 farther on the downstream side from substantially the middle of the rotor 6, i.e., the second cylinder 62 configuring the rotor 6, is a part that rotates as a rotating member of the thread groove exhaust portion Ps. The second cylinder 62 is inserted/stored, via a predetermined gap, between thread groove exhaust portion stators 18A, 18B having an inner/outer double cylindrical shape of the thread groove exhaust portion Ps.

Of the thread groove exhaust portion stators 18A, 18B in the inner/outer double cylindrical shape, the inner thread groove exhaust portion stator 18A is a cylindrical stator member having an outer circumferential surface thereof disposed facing the inner circumferential surface of the second cylinder 62, and is disposed in such a manner as to be surrounded by the inner circumference of the second cylinder 62. The outer thread groove exhaust portion stator 18B is a cylindrical stator member having an inner circumferential surface thereof disposed facing the outer circumferential surface of the second cylinder 62, and is disposed in such a manner as to surround the outer circumference of the second cylinder 62.

As a means for forming a thread groove exhaust flow channel R1 on the inner circumferential side of the rotor 6 (specifically, on the inner circumferential side of the second cylinder 62), a thread groove 19A that tapers conically downward with the diameter thereof reduced is formed in an outer circumferential portion of the inner thread groove exhaust portion stator 18A. The thread groove 19A is engraved into a spiral between the upper end and the lower end of the inner thread groove exhaust portion stator 18A. A thread groove exhaust flow channel for exhausting gas (referred to as "inner thread groove exhaust flow channel R1" hereinafter) is formed on the inner circumferential side of the second cylinder 62 by the inner thread groove exhaust portion stator 18A having the thread groove 19A.

As a means for forming a thread groove exhaust flow channel R2 on the outer circumferential side of the rotor 6 (specifically, on the outer circumferential side of the second cylinder 62), a thread groove 19B same as the thread groove 19A is formed in an inner circumferential portion of the outer thread groove exhaust portion stator 18B. A thread groove exhaust flow channel (referred to as "outer thread groove exhaust flow channel R2" hereinafter) is formed on the outer circumferential side of the second cylinder 62 by the outer thread groove exhaust portion stator 18B having the thread groove 19B.

Although not shown, the thread groove exhaust flow channels R1, R2 described above may be configured by forming the above-described thread grooves 19A, 19B on the inner circumferential surface and/or the outer circumferential surface of the second cylinder 62. These thread groove exhaust flow channels R1, R2 may be provided in respective parts of the portions on the inner and outer circumferential sides of the rotor 6.

The thread groove exhaust portion Ps takes advantage of the drag effect in the thread groove 19A and on the inner circumferential surface of the second cylinder 62 and the drag effect in the thread groove 19B and on the outer circumferential surface of the second cylinder 62, to transfer gas while compressing it. Therefore, the depth of the thread groove 19A is set to be the deepest at the upstream inlet side of the inner thread groove exhaust flow channel R1 (a flow channel opening end close to the inlet port 2) and the shallowest at the downstream exit side of the same (a flow channel opening end close to the outlet port 3). The same applies to the thread groove 19B.

An inlet of the outer thread groove exhaust flow channel R2 (the upstream end side) communicates with a gap between a stator blade 14E of the bottom stage among the stator blades 14 disposed in multiple stages and an upstream end of a communication opening H described hereinafter (referred to as "final gap G1" hereinafter). An exit of the flow channel R2 (the downstream end side) communicates with the outlet port 3 through a flow channel S on the in-pump outlet port side (referred to as "in-pump outlet port-side flow channel S" hereinafter).

An inlet of the inner thread groove exhaust flow channel R1 (the upstream end side) is opened toward the inner circumferential surface of the rotor 6 (i.e., an inner surface of the coupling portion 60) at substantially the middle of the rotor 6. An exit of the flow channel R1 (the downstream end side) communicates with the outlet port 3 through the in-pump outlet port-side flow channel S.

The in-pump outlet port-side flow channel S is formed to reach the outlet port 3 from the exits of the thread groove exhaust flow channels R1, R2, by providing a predetermined gap between the lower end of the rotor 6 or thread groove exhaust portion stator 18A, 18B and the inner bottom of the pump base 1B (a gap that circles a lower outer circumference of the stator column 4, in the vacuum pump P1 shown in FIG. 1).

The communication opening H is opened in substantially the middle of the rotor 6. The communication opening H penetrates through between the front and rear surfaces of the rotor 6 and thereby functions to guide some of the gas present on the outer circumferential side of the rotor 6 to the inner thread groove exhaust flow channel R1. The communication opening H having this function may be formed to, for example, penetrate through the inner and outer surfaces of the coupling portion 60 as shown in FIG. 1. In the vacuum pump P1 shown in FIG. 1, a plurality of the communication openings H are provided. The plurality of communication openings H are disposed point-symmetrical to the vacuum pump shaft center.

<<Explanation of Exhaust Operation in Thread Groove Exhaust Portion Ps>>

The gas molecules reaching the final gap G1 and the inlet (upstream end) of the thread groove exhaust flow channel R2 by being transferred by the exhaust operation of the blade exhaust portion Pt described above, shift from the thread groove exhaust flow channel R2 and the communication opening H to the thread groove exhaust flow channel R1. The shifted gas molecules then shift toward the in-pump outlet port-side flow channel S while being compressed from a transitional flow into a viscous flow, due to the effect caused by the rotation of the rotor 6, i.e., the drag effect on the outer circumferential surface of the second cylinder 62 and in the thread groove 19B and the drag effect on the inner circumferential surface of the second cylinder 62 and in the thread groove 19A. The gas molecules that have reached the in-pump outlet port-side flow channel S flow into the outlet port 3 and are exhausted to the outside of the casing 1 through an auxiliary pump, not shown.

<<Explanation of Partition Wall>>

The vacuum pump P1 shown in FIG. 1 employs a configuration in which a partition wall 21 covers the in-pump outlet port-side flow channel S by providing a partition wall installation space in the inner bottom of the pump base 1B configuring a part of an inner wall of the in-pump outlet port-side flow channel S and then installing the partition wall 21 in this space. Especially according to an example of a specific structure of the partition wall 21 in the vacuum pump P1 shown in FIG. 1, the outlet port-side end of the inner thread groove exhaust portion stator 18A extends as an extension 18A-1 to configure a part of the partition wall 21. A gap G4 is formed between the extension 18A-1 and the outer wall of the stator column 4 to ensure thermal insulation.

The partition wall 21 is formed of a good heat conductor (such as an aluminum alloy), configures a part of an inner wall of the in-pump outlet port-side flow channel S, and functions as a means for covering the inside of the in-pump outlet port-side flow channel S from the casing 1.

A gap G2 for heat insulation is provided between the partition wall 21 and the inner bottom of the pump base 1B (a part of the inner wall of the in-pump outlet port-side flow channel S). The partition wall 21 is also joined to other pump component (an inner circumferential step portion of the pump base 1B in the example shown in FIG. 1) through a heat insulating material 22 formed of a poor heat conductor (such as a stainless alloy, ceramic). A sealing means T1 functions as a means for preventing the gas from flowing backwards from the outlet port 3 to the upstream of the thread groove exhaust portion Ps through the gap G2. The heat insulating material 22 may also function to prevent the gas from flowing backward from the outlet port 3 to the upstream of the thread groove exhaust portion Ps.

In the vacuum pump P1 shown in FIG. 1, the gap G2 and the heat insulating material 22 inhibit the heat from moving from the partition wall 21 to the pump base 1B. Therefore, not only is it possible to keep the temperature of the partition wall 21 high and increase the temperature inside the in-pump outlet port-side flow channel S, but also the rise in the temperatures of the casing 1 (the pump base 1B, the pump case 1A) and the stator column 4 can effectively be prevented.

<<Explanation of Heating Means>>

The vacuum pump P1 shown in FIG. 1 employs a configuration in which the inner and outer thread groove exhaust portion stators 18A, 18B are positioned by attaching the thread groove exhaust portion stators 18A, 18B to the partition wall 21 by tightening bolts, and a configuration in which a rod-like heater HT functioning as a heating means is embedded in the partition wall 21, thereby heating the partition wall 21 with the heat generated by the heater HT itself and heating the thread groove exhaust portion stators 18A, 18B with the heat transmitted from the partition wall 21.

In the vacuum pump P1 shown in FIG. 1, heat that is generated as a result of compressing the gas with the thread groove exhaust flow channels R1, R2 (gas-compressed heat) is transmitted to the partition wall 21 through the thread groove exhaust portion stators 18A, 18B, and the transmitted heat is retained in the partition wall 21 by the gap G2 and the heat insulating material 22. Therefore, the temperature of the partition wall 21 is increased by the gas-compressed heat alone, and consequently the temperature of the inside of the in-pump outlet port-side flow channel S rises.

In addition, in the vacuum pump P1 shown in the same diagram, because the partition wall 21 can be heated by the heater HT, not only is it possible to further increase the temperature of the inside of the in-pump outlet port-side flow channel S while preventing the rise in the temperatures of the casing 1 and the stator column 4, but also the adhesion/accumulation of a product in the in-pump outlet port-side flow channel S can effectively be prevented.

Incidentally, the vacuum pump P1 shown in FIG. 1 is characterized in reducing the risk of the accumulation of a product even when the temperature at the final gap G1 or the vicinity of the outer wall portion of the stator column 4 is kept low, because the pressures at these locations are kept low.

<<Details of Outlet Port>>

According to a specific configuration the outlet port 3 of the vacuum pump P1 shown in FIG. 1, a through-hole 23 penetrates through the partition wall 21 from an outer side surface of the pump base 1B and communicates with the in-pump outlet port-side flow channel S, and a cylinder 24 functioning as a port member is attached to the through-hole 23 in the casing 1.

Furthermore, in the vacuum pump P1 shown in FIG. 1, one end of a cylinder 25 formed from a good heat conductor (such as an aluminum alloy) is joined to a penetrating portion 21A of the partition wall 21, thereby attaching the cylinder 25 to the partition wall 21, and another end of the attached cylinder 25 is inserted into the cylinder 24, forming the outlet port 3 into a multi-cylindrical structure configured with the inner and outer cylinders 24 and 25, wherein the cylinder 25 is disposed over the entire range between the inlet (upstream end) and the exit (downstream end) of the outlet port 3. The inner cylinder 25 is not in contact with the outer cylinder 24 or the pump base 1B and is disposed adiabatically away from these casings.

According to the above-described configuration of the outlet port 3, because the temperature of the inner cylinder 25 is increased by the heat of the partition wall 21 and the temperature in the vicinity of the exit of the outlet port 3 is kept high as a result of this temperature increase, the adhesion/accumulation of a product in the vicinity of the exit of the outlet port 3 can effectively be prevented. Note that the inner cylinder 25 may be omitted in a case where the temperature of the piping connected to the exit of the outlet port 3 is controlled and increased.

FIGS. 2 to 9 are each a cross-sectional view of a vacuum pump according to another embodiment of the present invention. The basic configurations of the vacuum pumps P2 to P9 shown in the respective diagrams are the same as the basic configuration of the vacuum pump P1 shown in FIG. 1; thus, in these diagrams, the same members as those shown in FIG. 1 are given the same reference numerals, and the detailed explanations thereof are omitted accordingly. Only the differences are described hereinafter.

Figure 2:
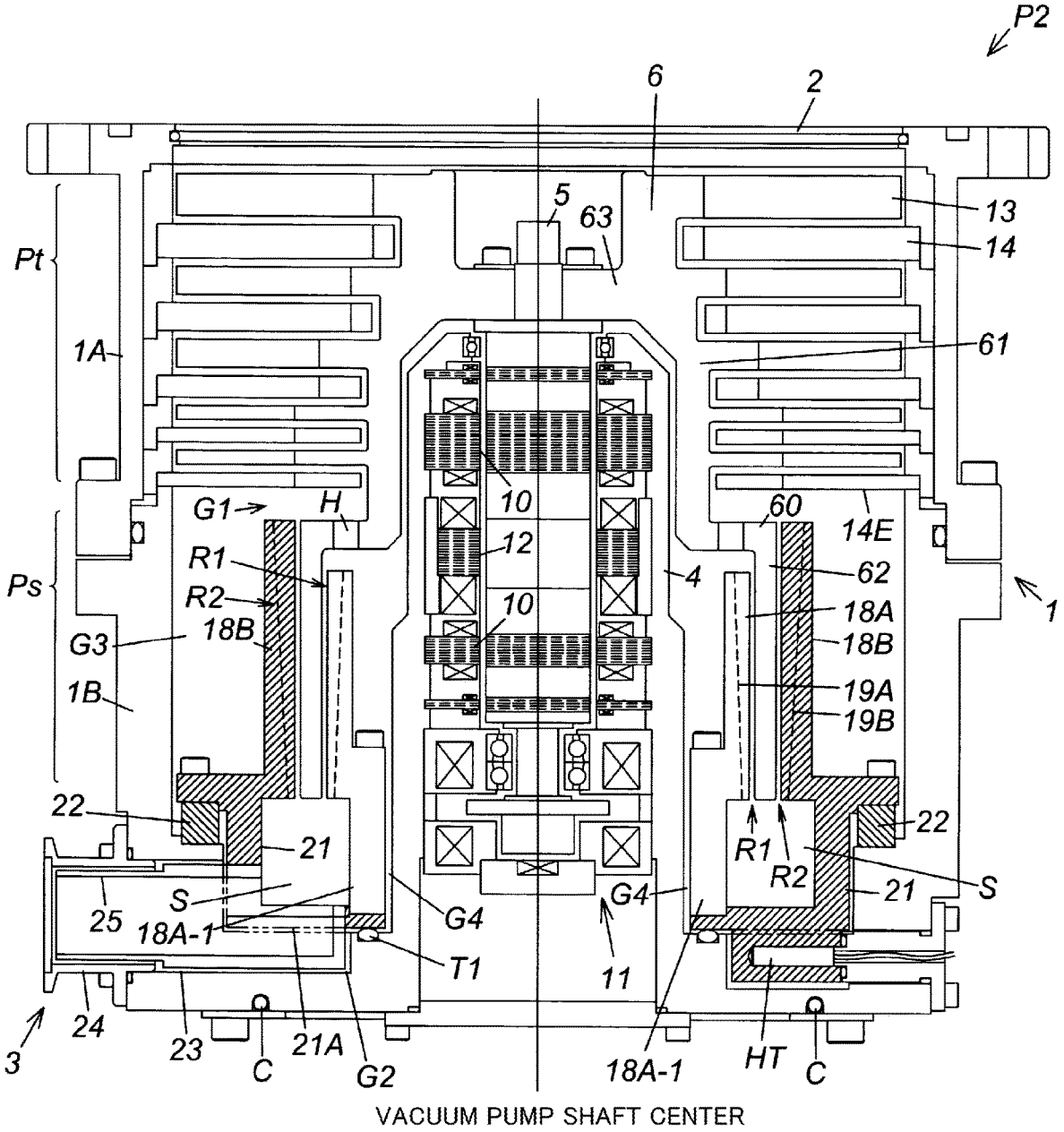
FIG. 2 is a cross-sectional view of a vacuum pump according to another embodiment of the present invention.

<<Characteristics of Vacuum Pump P2 of FIG. 2>>

Although the vacuum pump P1 shown in FIG. 1 has the outer thread groove exhaust portion stator 18B and the partition wall 21 as separate components, the vacuum pump P2 shown in FIG. 2 instead has the thread groove exhaust portion stator 18B and the partition wall 21 as a single component in order to reduce the number of components and the assembly time.

Figure 3:
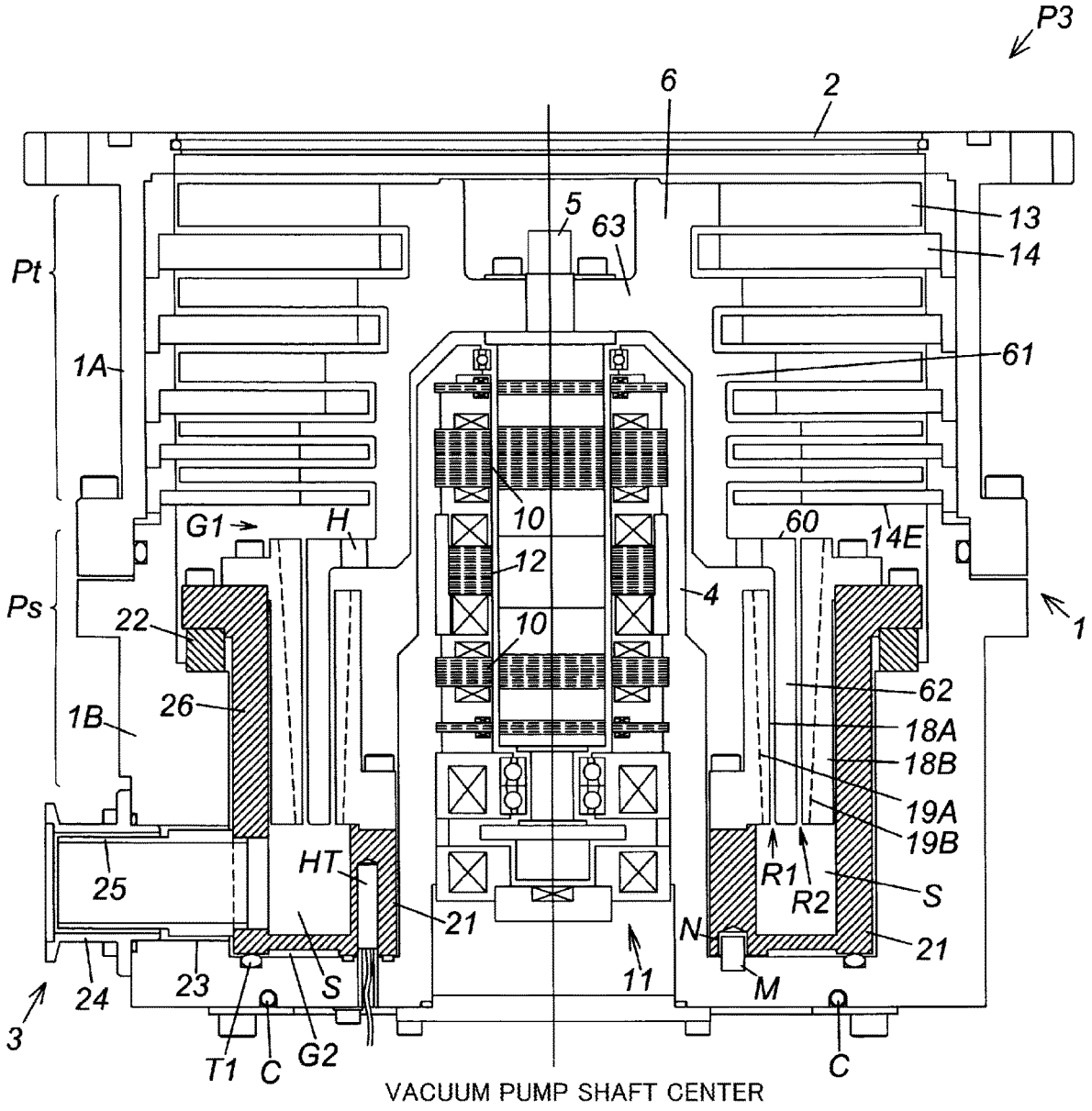
FIG. 3 is a cross-sectional view of a vacuum pump according to another embodiment of the present invention.

<<Characteristics of Vacuum Pump P3 of FIG. 3>>

In the vacuum pump P3 shown in FIG. 3, an in-pump space G3 (a gap between the outer thread groove exhaust portion stator 18B and the pump base 1B) shown in FIG. 1 is provided with an extended portion 26 formed by extending a part of the partition wall 21. This extended portion 26 functions as a means for reducing the amount of heat escaping from the outer thread groove exhaust portion stator 18B toward the pump base 1B through gas.

Specifically, in the vacuum pump P1 shown in FIG. 1, the gas molecules that are transferred by the exhaust operation of the blade exhaust portion Pt and reach the final gap G1 and the inlet (upstream end) of the thread groove exhaust flow channel R2 flow into the in-pump space G3. The higher the amount of gas flowing into the in-pump space G3, the higher the amount of heat escaping from the outer thread groove exhaust portion stator 18B toward the pump base 1B through the gas inside the in-pump space G3. In the vacuum pump P3 shown in FIG. 3, on the other hand, the amount of gas flowing into the in-pump space G3 is reduced due to the presence of the extended portion 26 of the partition wall 21 in the in-pump space G3, and as a result the amount of heat escaping from the outer thread groove exhaust portion stator 18B toward the pump base 1B is reduced.

In the vacuum pump P3 shown in FIG. 3, as a means for preventing the partition wall 21 from being rotated by a breaking torque when the rotor 6 is damaged upon contact with an accumulated product, a stopper M is provided upright on the inner bottom surface of the pump base 1B, and a depression N is provided on the partition wall 21 so as to correspond to the stopper M, wherein the stopper M is disposed in this depression N. Note that the stopper M is not in contact with the depression N, for the purpose of preventing the heat from escaping from the partition wall 21 toward the pump base 1B through the stopper M.

Figure 4:
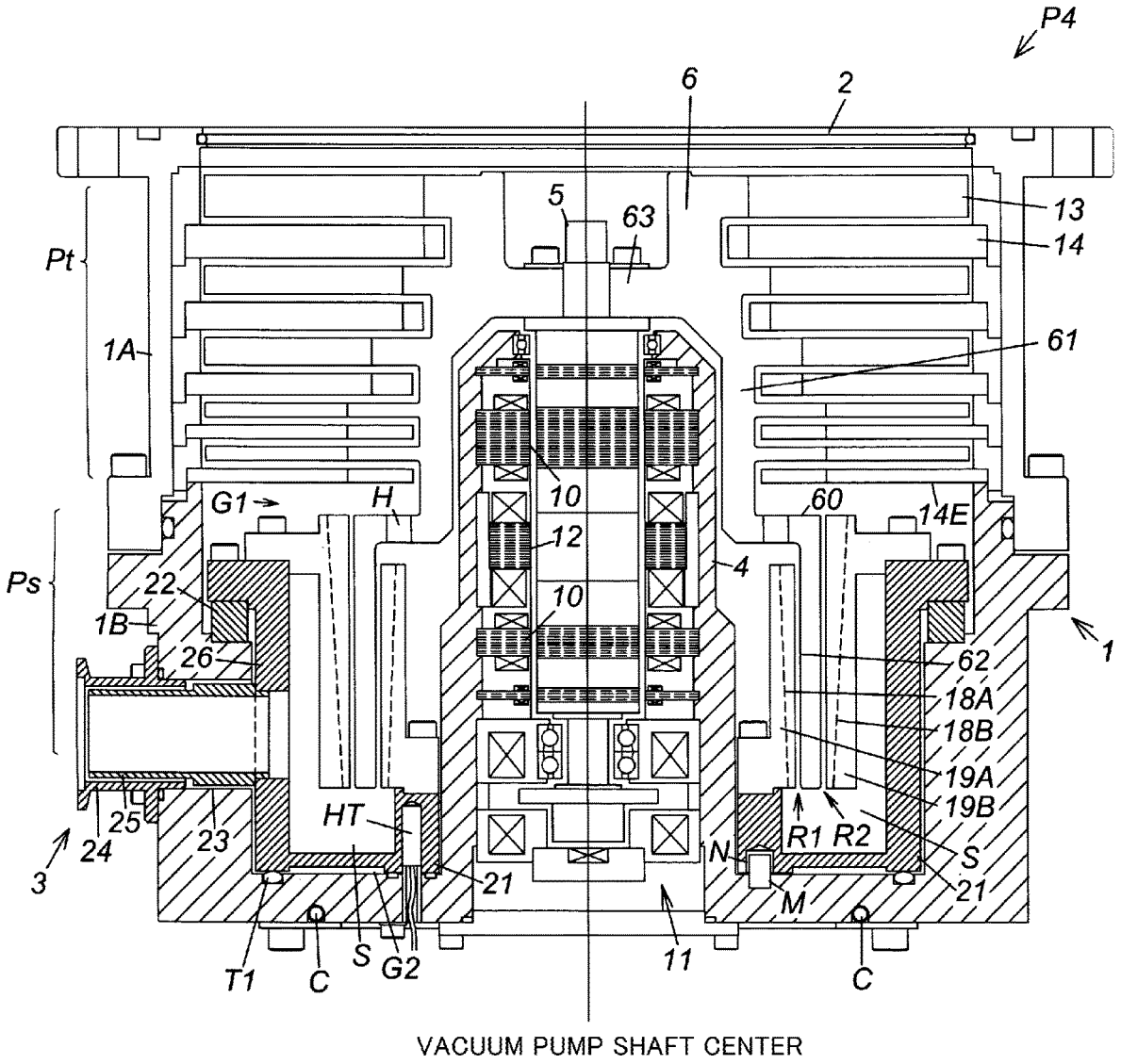
FIG. 4 is a cross-sectional view of a vacuum pump according to another embodiment of the present invention.

<<Characteristics of Vacuum Pump P4 of FIG. 4>>

In the vacuum pump P1 shown in FIG. 1, the outlet port 3 is provided at the lower end of the rotor 6 or a position below the lower ends of the thread groove exhaust portion stators 18A, 18B. In the vacuum pump P4 shown in FIG. 4, on the other hand, the outlet port 3 is provided at, for example, a higher position in such a manner that the lower portion of the outlet port 3 and the lower end of the rotor 6 or the lower ends of the thread groove exhaust portion stators 18A, 18B are positioned substantially side by side. In this manner, the height of the in-pump outlet port-side flow channel S is set low, reducing the length/size of the entire vacuum pump P4 in the direction of the vacuum pump shaft center.

Figure 5:
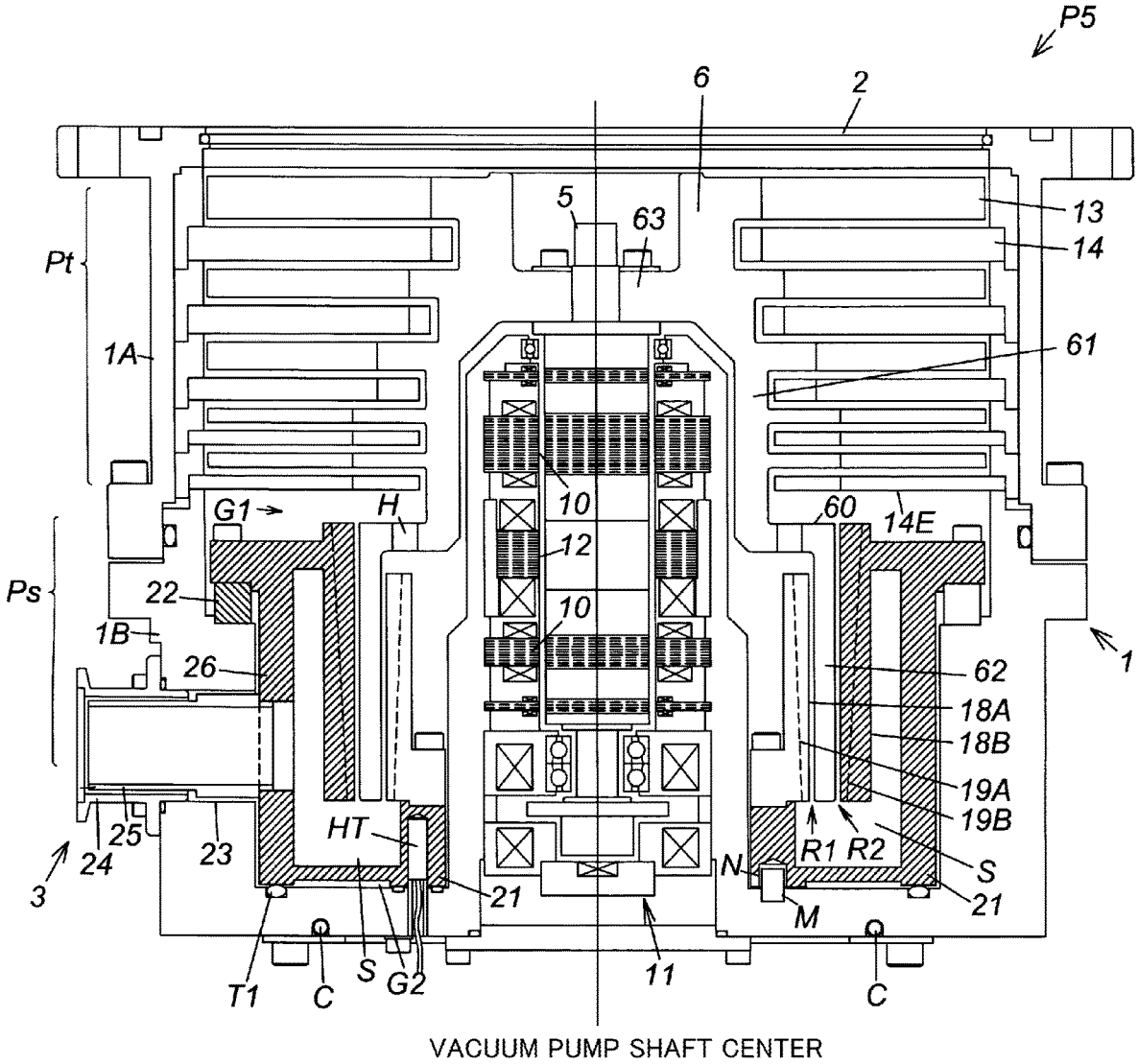
FIG. 5 is a cross-sectional view of a vacuum pump according to another embodiment of the present invention.

<<Characteristics of Vacuum Pump P5 of FIG. 5>>

In the vacuum pump P1 shown in FIG. 1, the outer thread groove exhaust portion stator 18B and the partition wall 21 are configured as separate components. In the vacuum pump P5 shown in FIG. 5, on the other hand, the thread groove exhaust portion stator 18B and the partition wall 21 are integrally formed into a single component by casting or the like, in order to reduce the number of components.

Figure 6:
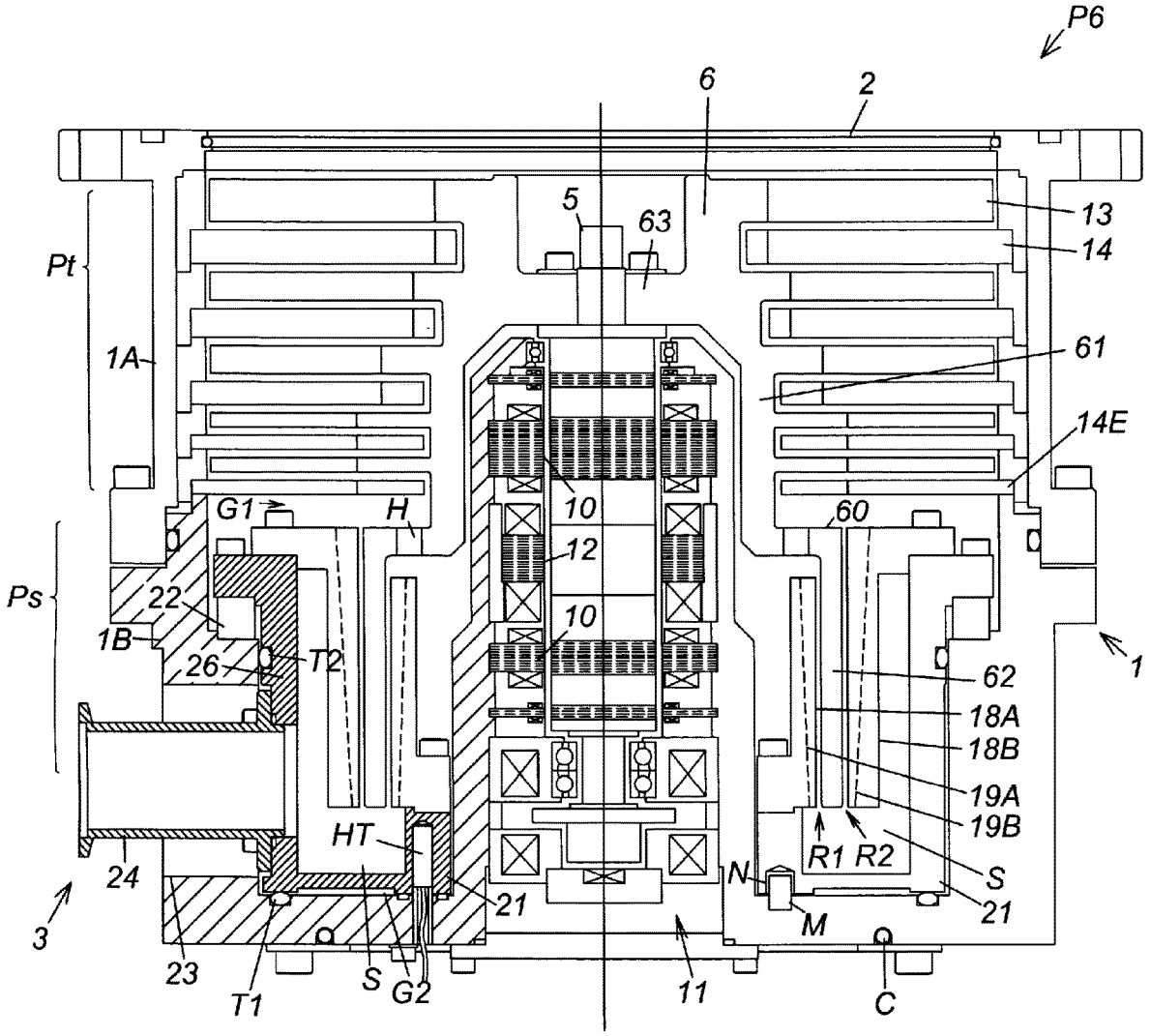
FIG. 6 is a cross-sectional view of a vacuum pump according to another embodiment of the present invention.

<<Characteristics of Vacuum Pump P6 of FIG. 6>>

According to the specific configuration of the outlet port 3 of the vacuum pump P1 shown in FIG. 1, the cylinder 24 functioning as a port member is fitted and attached to the through-hole 23 of the pump base 1B. In the vacuum pump P6 shown in FIG. 6, on the other hand, the through-hole 23 is expanded so that the through-hole 23 and the cylinder 24 do not come into contact with each other. In addition, the inlet (upstream end) side of the cylinder 24 is stretched to the penetrating portion 21A of the partition wall 21 and then fitted/joined to the penetrating portion 21A, thereby directly attaching the cylinder 24 to the partition wall 21. In this case, the outlet port 3 is configured only with the cylinder 24 and installed so as not to be in contact with the pump components other than the partition wall 21.

According to such configuration of the outlet port 3, because the cylinder 24 itself is heated by the heat of the partition wall 21, the above-described cylinder 25 shown in FIG. 1 can be omitted, reducing the number of components and the assembly time.

Note in the vacuum pump P6 shown in FIG. 6 that sealing means T1, T2 each function as a vacuum seal for preventing air from flowing into the pump through the through-hole 23.

Figure 7:
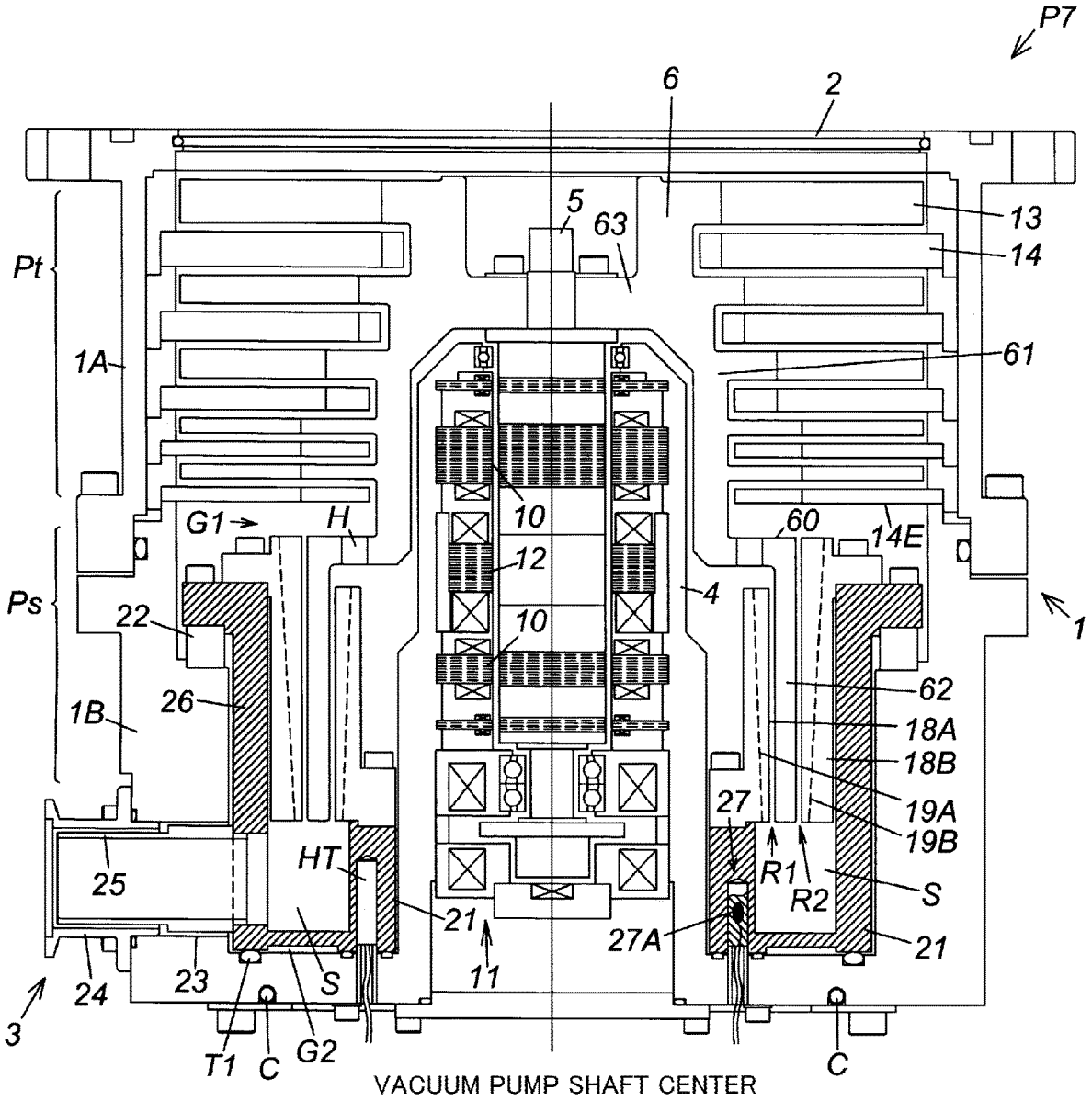
FIG. 7 is a cross-sectional view of a vacuum pump according to another embodiment of the present invention.

<<Characteristics of Vacuum Pump P7 of FIG. 7>>

In the vacuum pump P7 shown in FIG. 7, a temperature measuring element 27A formed from a thermistor, a thermocouple, a platinum resistor or the like is embedded in the partition wall 21 as a temperature measuring means 27, and a control means, not shown, for controlling the heating means (heater HT) based on a measured value obtained by the temperature measuring element 27A is provided. According to this configuration, not only is it possible to control the temperature of the partition wall 21, but also overheating of the inside of the pump can be prevented.

The control means for controlling the heating means (heater HT) may execute a combination of, for example, current control for increasing/reducing the value of current flowing to the heater HT and flow rate control for increasing/reducing the flow rate of a cooling medium flowing through a cooling pipe C installed in the pump base 1B, by adjusting a valve of the cooling pipe C, not shown.

The temperature measuring means 27 and the control means can be applied to the vacuum pumps P1 to P6 shown in FIGS. 1 to 6. The temperature measuring means 27 may be installed in thread groove pump stators 18*a*, 18*b*. The same applies to the heating means (heater HT).

Figure 8:
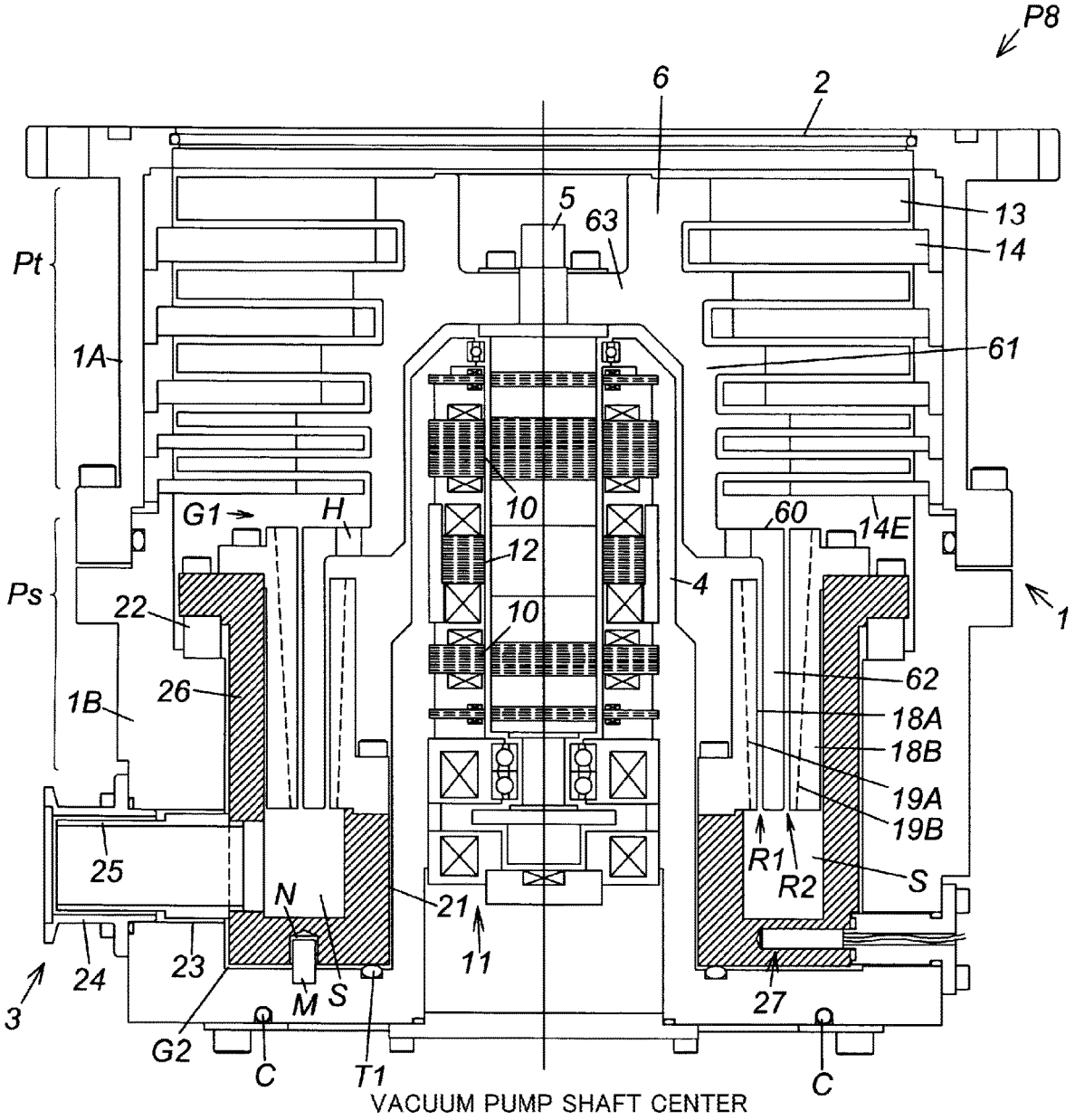
FIG. 8 is a cross-sectional view of a vacuum pump according to another embodiment of the present invention.

<<Characteristics of Vacuum Pump P8 of FIG. 8>>

According to a specific example of installing the temperature measuring means 27 in the vacuum pump P7 shown in FIG. 7, the temperature measuring means 27 is embedded in the partition wall 21 substantially along the direction of the vacuum pump shaft center (vertical setting). In the vacuum pump P8 shown in FIG. 8, on the other hand, the temperature measuring mean 27 is embedded in the partition wall 21 along the direction substantially perpendicular to the direction of the vacuum pump shaft center (horizontal setting).

While the vertical setting of the temperature measuring element 27A described above requires the height of the partition wall 21 to be taller than at least the length of the temperature measuring element 27A, the horizontal setting of the temperature measuring element 27A does not need such a tall partition wall 21 and therefore can have the height of the partition wall 21 set low, reducing the length/size of the entire vacuum pump P7 in the direction of the vacuum pump shaft center.

Figure 9:
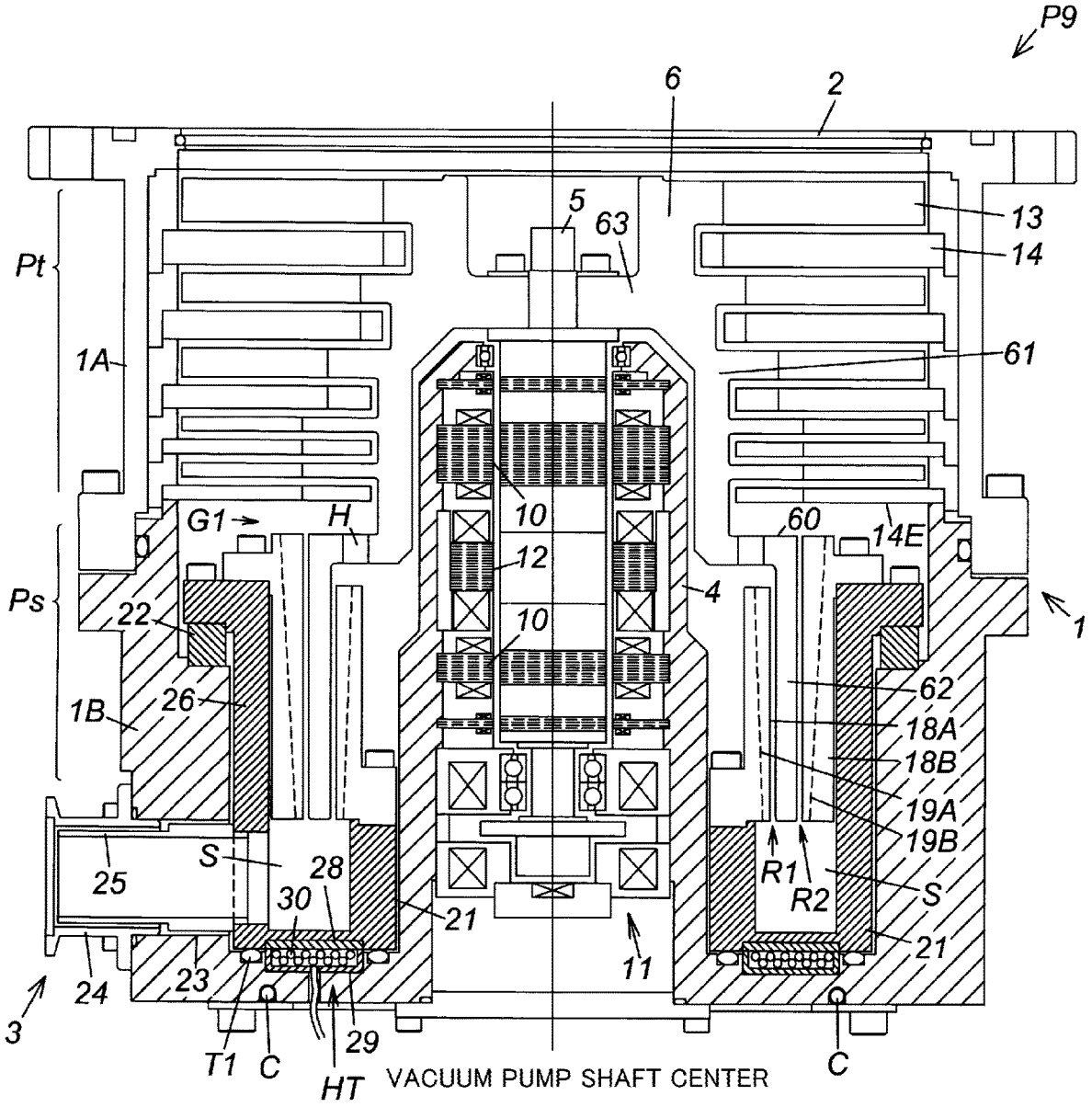
FIG. 9 is a cross-sectional view of a vacuum pump according to another embodiment of the present invention.
Figure 10:
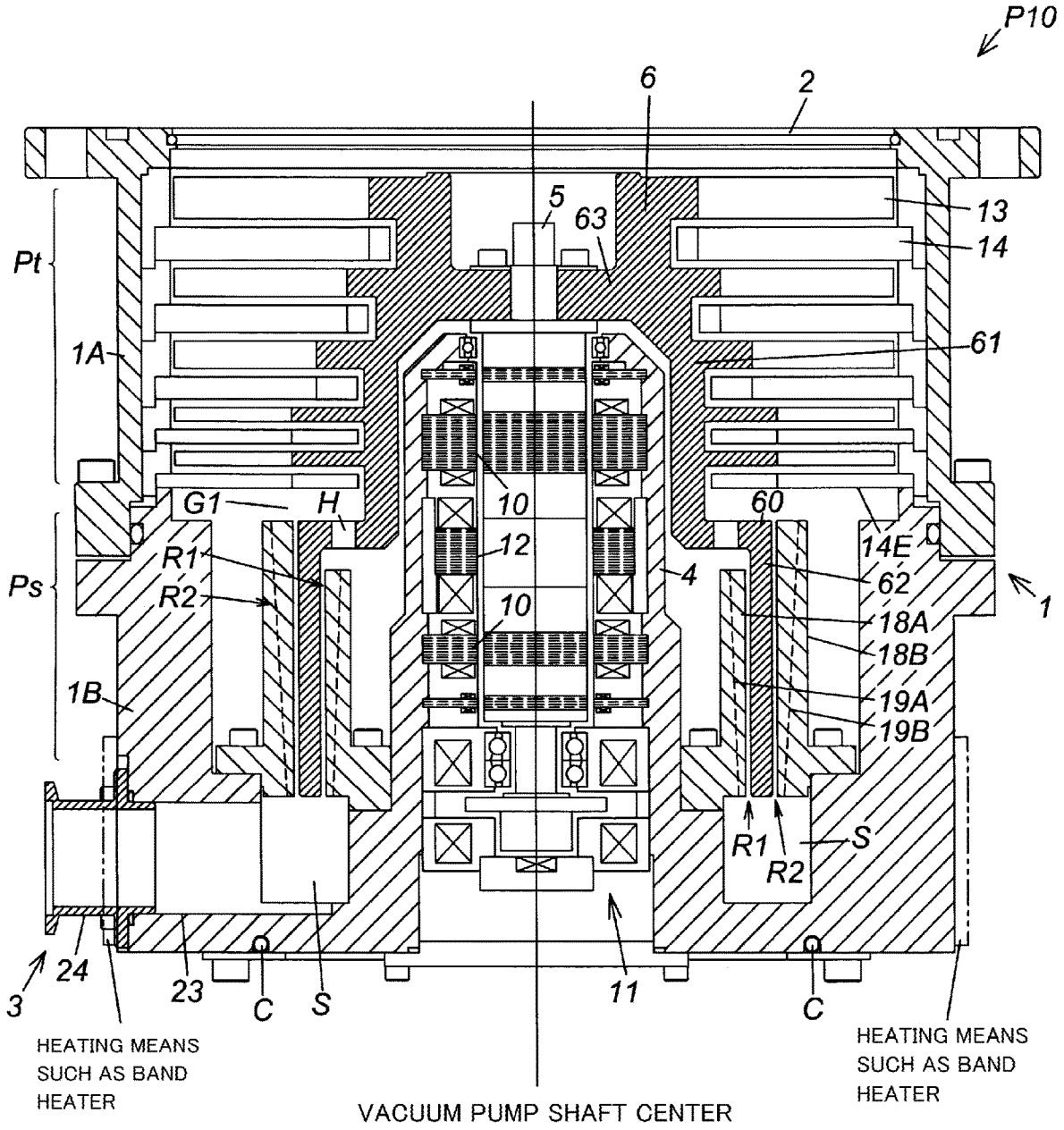
FIG. 10 is a cross-sectional view of the conventional vacuum pump.

<<Characteristics of Vacuum Pump P9 of FIG. 9>>

A specific example of the heating means of the vacuum pump P1 shown in FIG. 1 employs the configuration in which the partition wall 21 is heated by the heat generated by the heater HT itself. The vacuum pump P9 shown in FIG. 9 instead employs a configuration in which the partition wall 21 is heated by an electromagnetic induction heating system using a coil 30.

This electromagnetic induction heating system is configured with a ferromagnetic substance with small electrical resistance that is installed as a heat-generating core 28 in an outer bottom surface of the partition wall 21, a ferromagnetic substance with large electrical resistance that is installed in the pump base 1B as a yoke 29 that faces the heat-generating core 28, and the coil 30 housed in the yoke 29. This configuration is merely an example; thus, the configuration of the electromagnetic induction heating system may be modified as necessary.

In the electromagnetic induction heating system having the configuration described above, when an AC current is fed to the coil 30, an eddy current is generated on the inside of the heat-generating core 28, and the heat-generating core 28 itself generates heat, heating the partition wall 21. Because the yoke 29 has large electrical resistance, the heat generated by the yoke 29 itself in this electromagnetic induction heating system is negligibly small. Therefore, the heat generated by the yoke 29 does not increase the temperature of the pump base 1B.

The specific configurations of the vacuum pumps P1 to P9 of the embodiments described above each employ the configuration in which the partition wall 21 is provided in the in-pump outlet port-side flow channel S that extends from the exits of the thread groove exhaust flow channels R1, R2 to the outlet port 3, wherein the partition wall 21 covers the inside of the in-pump outlet port-side flow channel S from the casing 1. Thus, the accumulation of a product that is caused by a decrease in the temperature of the process gas in the vicinity of the exits of the thread groove exhaust flow channels R1, R2 and in the in-pump outlet port-side flow channel S can be prevented owing to the facts that the temperature of the process gas passing through the in-pump outlet port-side flow channel S and the vicinity of the exits of the thread groove exhaust flow channels R1, R2 does not drop easily and that the wall temperatures of the in-pump outlet port-side flow channel S and the vicinity of the exits of the thread groove exhaust flow channels R1, R2 can be kept high.

In addition, according to the vacuum pumps P1 and P2, because the entry and exit of the heat between the in-pump outlet port-side flow channel S and the casing 1 is inhibited by the partition wall 21, not only is it possible to efficiently heat only the in-pump outlet port-side flow channel S and the vicinity of the exits of the thread groove exhaust flow channels R1, R2, but also the temperature of the casing 1 can be prevented from being increased by this heating. Consequently, the rise in the temperatures of the stator column 4 coupled to the casing 1 and the electrical components housed in the stator column 4 (the radial magnetic bearings 10, the drive motor 12, and the like) can be prevented, thereby avoiding the problems associated with overheating of these electrical components. In addition, the temperature of the in-pump outlet port-side flow channel S does not drop even if the casing 1 is provided with a cooling means for protecting the stator column 4 and the electrical components housed in the stator column 4 to cool the casing 1.

The present invention is not limited to the embodiments described above, and various modifications can be made by anyone with conventional knowledge in this field, within the technical idea of the present invention.

For instance, the present invention can be applied to a vacuum pump that does not have the blade exhaust portion Pt of the vacuum pumps of the embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a thread groove exhaust portion that has an inner thread groove exhaust flow channel on an inner circumferential side of a rotating body and an outer thread groove exhaust flow channel on an outer circumferential side of the rotating body;

a casing enclosing the thread groove exhaust portion;

an outlet port for exhausting gas compressed by the thread groove exhaust portion to the outside of the casing and comprising an outer cylinder; and a partition wall that covers a flow channel extending from a first exit of the inner thread groove exhaust flow channel and a second exit of the outer thread groove exhaust flow channel toward the outlet port, wherein the partition wall is connected to an inner thread groove exhaust portion stator on the inner circumferential side of the rotating body and an outer thread groove exhaust portion stator on the outer circumferential side of the rotating body which are configuring the thread groove exhaust flow channels, a heating means is embedded in the partition wall, and the outer cylinder is attached to the partition wall and does not contact the casing.

2. The vacuum pump according to claim 1, wherein the partition wall is joined to a pump component other than the inner thread groove exhaust portion stator and the outer thread groove exhaust portion stator through a heat insulating material.

3. The vacuum pump according to claim 1, wherein the partition wall or the inner thread groove exhaust portion stator or the outer thread groove exhaust portion stator is provided with a temperature measuring means.

4. The vacuum pump according to claim 1, further comprising a control means for controlling the heating means.

5. The vacuum pump according to claim 1, wherein the outlet port is installed so as not to be in contact with a pump component other than the partition wall.

6. The vacuum pump according to claim 2, wherein the partition wall or the inner thread groove exhaust portion stator or the outer thread groove exhaust portion stator is provided with a temperature measuring means.

7. The vacuum pump according to claim 2, wherein the outlet port is installed so as not to be in contact with a pump component other than the partition wall.

8. The vacuum pump according to claim 3, wherein the outlet port is installed so as not to be in contact with a pump component other than the partition wall.

9. A vacuum pump, comprising:

a thread groove exhaust portion that has an inner thread groove exhaust flow channel on an inner circumferential side of a rotating body and an outer thread groove exhaust flow channel on an outer circumferential side of the rotating body;

a casing enclosing the thread groove exhaust portion;

an outlet port for exhausting gas compressed by the thread groove exhaust portion to the outside of the casing and comprising an outer cylinder; and a partition wall that covers a flow channel extending from a first exit of the inner thread groove exhaust flow channel and a second exit of the outer thread groove exhaust flow channel toward the outlet port, wherein the partition wall is connected to an inner thread groove exhaust portion stator on the inner circumferential side of the rotating body and an outer thread groove exhaust portion stator on the outer circumferential side of the rotating body which are configuring the thread groove exhaust flow channels, a heating means is embedded in the partition wall, and the outer cylinder encloses an inner cylinder attached to the partition wall and is not in contact with the inner cylinder.

10. The vacuum pump according to claim 9, wherein the partition wall is joined to a pump component other than the inner thread groove exhaust portion stator and the outer thread groove exhaust portion stator through a heat insulating material.

11. The vacuum pump according to claim 9, wherein the outer cylinder is attached to the casing.

12. The vacuum pump according to claim 9, wherein the partition wall or the inner thread groove exhaust portion stator or the outer thread groove exhaust portion stator is provided with a temperature measuring means.

13. The vacuum pump according to claim 9, further comprising a control means for controlling the heating means.

14. The vacuum pump according to claim 10, wherein the outer cylinder is attached to the casing.

15. The vacuum pump according to claim 10, wherein the partition wall or the inner thread groove exhaust portion stator or the outer thread groove exhaust portion stator is provided with a temperature measuring means.

16. The vacuum pump according to claim 11, wherein the partition wall or the inner thread groove exhaust portion stator or the outer thread groove exhaust portion stator is provided with a temperature measuring means.

* * * * *